United States Patent [19]

Hopkins

[11] 4,426,067

[45] Jan. 17, 1984

[54] METALLIC SECTIONAL LIQUID-COOLED RUNNERS

[75] Inventor: Robert W. Hopkins, Boca Raton, Fla.

[73] Assignee: The Calumite Company, Trenton, N.J.

[21] Appl. No.: 456,204

[22] Filed: Jan. 7, 1983

[51] Int. Cl.[3] ..... C21B 7/14

[52] U.S. Cl. ..... 266/191; 266/46; 266/196; 266/236

[58] Field of Search ..... 266/46, 191, 196, 236

[56] References Cited

U.S. PATENT DOCUMENTS

| | | | |
|---|---|---|---|
| 1,625,755 | 4/1927 | Williams et al. | 266/191 |
| 1,881,228 | 10/1932 | Pape | 266/191 |
| 2,567,911 | 9/1951 | Miller | 266/191 |
| 2,801,162 | 7/1957 | Keeping | 75/63 |
| 3,198,974 | 8/1965 | Havens | 65/169 |
| 4,177,974 | 12/1979 | Higuchi et al. | 266/196 |

FOREIGN PATENT DOCUMENTS

| | | | |
|---|---|---|---|
| 53-87994 | 8/1978 | Japan | 266/191 |

*Primary Examiner*—M. J. Andrews

*Attorney, Agent, or Firm*—Frederick A. Zoda; John J. Kane

[57] ABSTRACT

A runner for conveying molten pig iron and slag from a blast furnace of a steel manufacturing facility, is of wholly metallic construction and is hollowly formed to provide a cooling jacket through which water is circulated. Each runner so formed is an individual section in a string of other, similarly formed runners each of which has its own inlet connected to a source of water under pressure, and its own outlet to a suitable drain or reservoir where water temperature may be measured and observed. Water entering each section through the inlet courses through a tube that extends within the jacket substantially from one end to the other end, adjacent the slag channel of the runner, then extends transversely of the channel to the other side of the runner, thereafter extending longitudinally of said other side. The water flows out of the tube, within the jacket, after having extended along both sides of the channel in heat exchange relation to the slag flowing through the channel. The water discharged from the tube within the jacket now flows through the jacket, reversing its path from the tube outlet back to the area of the tube inlet, where it is discharged from the jacket for flow to the drain reservoir.

14 Claims, 7 Drawing Figures

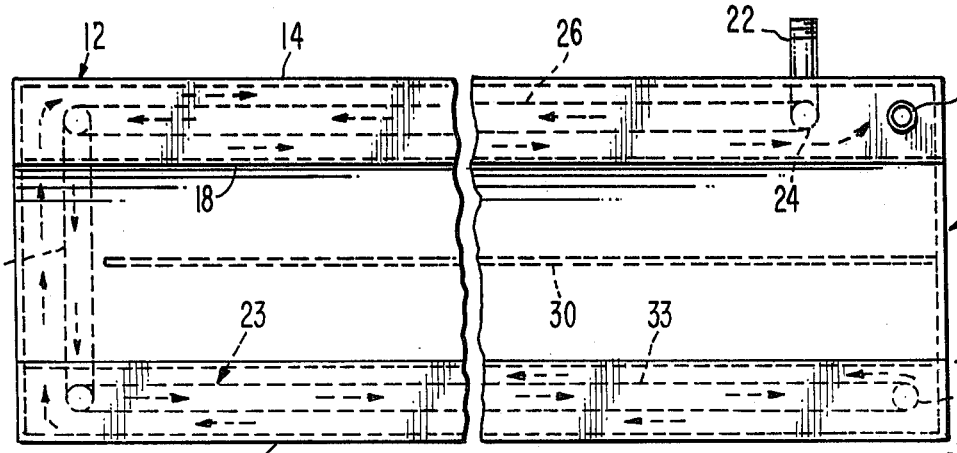
Fig. 2.
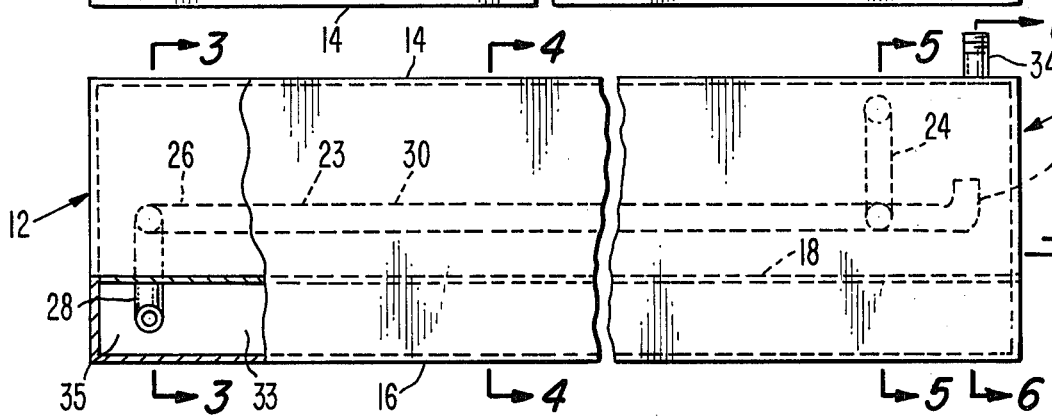
Fig. 1.
Fig. 3.
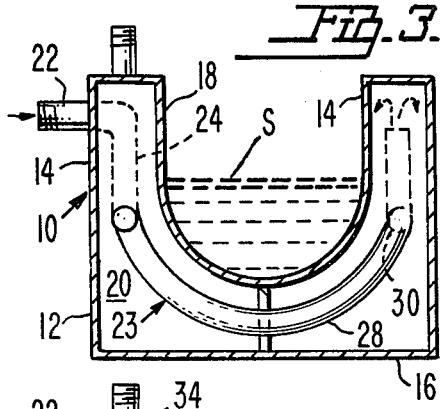
Fig. 4.
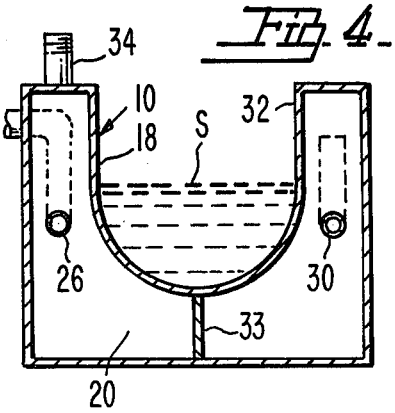
Fig. 6.
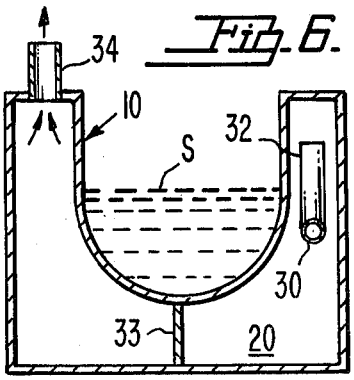
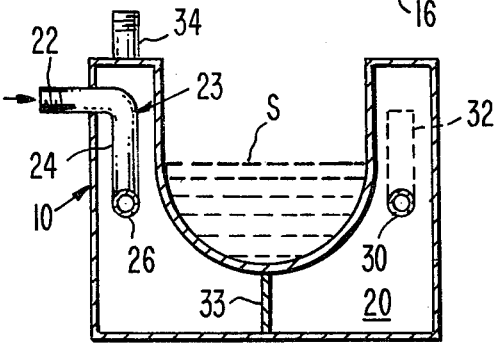
Fig. 5.
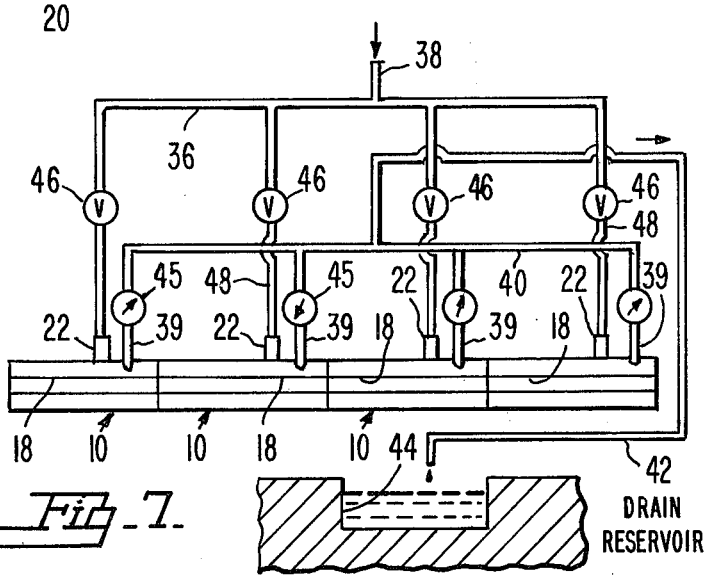
Fig. 7.

METALLIC SECTIONAL LIQUID-COOLED RUNNERS

BACKGROUND OF THE INVENTION

1. Field of the Invention

The present invention relates generally to the art of manufacturing runners of the type used in blast furnace facilities for the purpose of carrying off molten slag. In a more particular sense, the invention relates to runners falling within this general category, characterized by their being of hollow construction, with means for introducing a cooling medium such as water for the purpose of cooling the molten slag to a desired temperature.

2. Description of the Prior Art

It is common practice to construct runners of a refractory material, for the purpose of forming a trough leading from a blast furnace to a car into which slag flows from the blast furnace. The molten material from the blast furnace includes, typically, both cast iron and slag. These are separated after they flow from the furnace.

Refractory material is used due to the fact that the runners wear out rapidly by reason of the abrasive effect of the molten material upon the surfaces of the runners. Indeed, in some areas of the steel industry, specially prepared refractory materials and services are employed, involving considerable expense in view of the necessity of frequent replacement thereof. Even so, the arrangements presently employed are not totally satisfactory, because the failure to cool the molten material under accurately controlled conditions results in the fact that foreign particles form in the slag and, indeed, in the pig iron as well.

The slag, although considered basically as a waste material, has many uses in other industries. For example, in the glass-making industry, the slag can be specially compounded, sized, and blended to form an important ingredient in glass making materials. This is disclosed, for example, in U.S. Pat. No. 3,822,799 to Evans, issued July 9, 1974, disclosing a method of producing a blast furnace slag product adapted for use in the manufacture of glass, by depositing successive loads of slag each having a composition within a predetermined range.

In order to produce compositions of this type, however, it is desirable that the slag be as free as possible of stones and other foreign materials forming therein if improperly cooled during the flow of the slag from the furnace to the cars used for transferring the slag to a dumping location. There thus exists at least two reasons for improving the controlled cooling of the slag as it passes within the trough or channel defined by the end-to-end runners: (a) the desirability of reducing the frequency with which runners must be replaced; and (b) minimizing the formation of "stones" and other hard foreign particles that may later resist reduction to granular sizes required in, for example, the glass-making art.

Heretofore, metal runners have been devised, including runners having tubes arranged in a tortuous path within the walls of the runners, for the purpose of circulating cooling water therethrough. However, so far as is known these have not found great popularity, perhaps because the arrangement of the tubes and tortuous passageways has not been conducive to controlled, efficient, progressive cooling of the molten slag.

SUMMARY OF THE INVENTION

The present invention, summarized briefly, is an improved runner, or more accurately, a runner section, which is adapted to be joined end-to-end with other similarly formed sections, to provide a complete runner assembly that would extend from the blast furnace to, typically, a slag transfer car. The runner comprising the present invention has an end-to-end channel through which the molten slag may flow, and is otherwise constituted as a completely hollow member, forming a cooling jacket for the molten slag. The runner would be of metallic material, with walls which, though preferably as thin as possible to promote heat transfer between the molten slag material and the cooling medium, will nevertheless be possessed with the requisite strength to resist breakdown under the difficult operating conditions to which runners of this type are normally subjected.

Within the hollow cooling chamber of the runner, there is extended a tube, having an inlet and outlet extending exteriorly of the runner. The tube has an inlet at one end of the runner, through which water is forced under pressure. The tube passes longitudinally of the runner in close proximity to the slag channel, along one side wall of the runner, to a location adjacent the other end thereof. At this point the tube extends transversely below and in close proximity to the slag channel, and then continues along the other side of the runner substantially from end-to-end thereof. The discharge end of the tube is located within the chamber in which the tube is mounted, so that the cooling medium, after passing the length of the tube, now flows into and fills the chamber, and is caused to flow back through the chamber substantially along the same path that the water followed when passing through the tube. Close to the inlet end of the tube, the chamber has an outlet for the cooling medium.

All sections of a complete runner assembly can be individually connected to a common manifold, through which water is forced under pressure into the runner sections. In this way, all sections receive water of the same temperature. The outflow of water from the several sections is similarly directed into an outlet manifold, leading to a drain reservoir or the like, where the temperature of the water can be continuously monitored so as to assure uniformity in the cooling and completely accurate control of the cooling medium at all times. By monitoring the outflow temperature, one can also adjust the temperature of the water within the inlet manifold, either upwardly or downwardly, so as to maintain the cooling medium at a desirable, pre-selected range of temperatures.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

FIG. 1 is a side elevational view of a runner according to the present invention, a portion being broken in section and other portions being broken away;

FIG. 2 is a top plan view thereof;

FIGS. 3, 4, 5, and 6 are transverse sectional views taken substantially on lines 3—3, 4—4, 5—5, and 6—6 respectively; and FIG. 7 is a somewhat schematic view of a complete runner and cooling system according to the present invention.

DETAILED DESCRIPTION OF THE PREFERRED EMBODIMENT

The reference numeral 10 has been applied generally to a single runner section according to the present invention. As will be noted from FIG. 7, several of the runners are secured in end-to-end relation, to provide a continuous channel through which blast furnace slag may flow upon discharge from the blast furnace.

Accordingly, the description of a single runner 10 will suffice for all of those illustrated in FIG. 7.

The runner 10, when formed according to the present invention, may be generally described as an elongated, completely hollow body, designated 12, having side walls 14 and a bottom wall 16. The body, thus formed, defines an end-to-end flow channel 18 for the molten slag S.

The entire body is of relatively thin-walled formation, and is composed wholly of metal material in a preferred embodiment. The provision of a body so formed thus defines, within the body, a cooling chamber or jacket 20 within which, as will presently appear, water flows as a cooling medium to cool the slag accurately and under pre-selected conditions, during its flow through the channel 18.

To this end, there is provided, on one side wall 14, near one end of the body, a laterally outwardly projecting inlet fitting 22, adapted for connection to a source of water under pressure in a manner to be discussed in greater detail hereinafter. Fitting 22 is provided on the inlet end of an elongated cooling tube generally designated 23. Tube 23, thus, begins near one end of the body, at the location of the inlet fitting 22, and at this end is formed with an inlet portion 24 extending downwardly from the fitting 22 and merging, at its lower end, into a first longitudinal tube portion 26.

Referring to FIG. 2, the first longitudinal portion 26 extends from the inlet portion 24 of the tube for almost the full length of the side wall 14 within which it is mounted. As will be noted from the several figures of the drawing, the longitudinal portion is confined wholly within the cooling chamber 20, in spaced relation to the walls of the chamber but in close proximity to the channel 18. This promotes heat transfer between the molten slag material and the cooling medium flowing through the tube 23.

The longitudinal portion 26, again referring to FIG. 2, terminates a short distance inwardly from the other end of the runner, merging at this point into a transverse portion 28. Transverse portion 28 is shown to particular advantage in FIG. 3, and as will be noted, extends across the second end of the runner, remaining at a uniform spaced relationship to the wall of the channel 18. In the illustrated example, the channel 18 is shown as having a curved bottom wall, but of course this is not essential to the invention and in many instances, the bottom wall may be flat. In this event, the transverse portion 28 would also be flat, so as to preserve the uniformly spaced relationship of the transverse portion 28 and the bottom wall of the slag channel 18.

By reason of the provision of the transverse portion 28, the tube crosses over to the opposite side wall 14, again as best shown in FIG. 3, where it now merges into a second longitudinal tube portion 30. This portion duplicates the portion 26, extending from the second end of the runner, shown as the left hand end in FIGS. 1 and 2, almost the full length of the runner side wall 14 within which it is mounted.

The second longitudinal portion 30 terminates in closely spaced relation to the first named end of the runner, shown as the right hand end in FIGS. 1 and 2. At this point the tube 30 merges into an upwardly projecting outlet portion 32, which opens directly into the cooling chamber 20.

The water which has flowed through the entire length of the tube, that is, through tube portions 24, 26, 28, 30, and 32, is now discharged as shown in FIG. 6, directly into the chamber 20.

Extending longitudinally and centrally of the runner, and dividing the chamber into left and right halves is a partition 33. Longitudinal partition 33 extends fully from the right hand end of the runner, viewing the same as in FIG. 2, to a location just short of the transverse tube portion 28, that is, short of the left hand end of the runner, thus defining beyond the end of the partition, an opening 35 communicating the opposite sides of the chamber with one another. The partition extends fully from the bottom wall of the channel to the bottom of the runner body, and as a result, water flowing out of the outlet portion 32 is caused to reverse its path, flowing to the left in FIGS. 1 and 2 along tube portion 30, and crossing over through opening 35 to the opposite side of the chamber. At the opposite side of the chamber, the water flows back toward a chamber outlet 34, where the water is discharged.

It is thus seen that the cooling medium first flows through a tube confined within the cooling chamber, in one direction. Then, when discharged from the tube, it flows back through the chamber exteriorly of the tube in the opposite direction.

This maximizes the cooling effect of the circulated water, promoting efficient heat exchange between the cooling medium and the molten slag for the purpose of cooling the slag as it flows through the channel 18.

Referring to FIG. 7, there is schematically illustrated a system for directing water into the tubes of the several runners 10 when they are assembled in end-to-end relationship to provide a complete runner assembly. Thus, water may enter an inlet manifold 36, through an inlet 38 connected to a source of water under pressure. The manifold 36 distributes the water to the several inlet fittings 22, so that water of the same temperature is simultaneously forced into all of the cooling tubes of the several runners.

In the same way, water discharged from the several runners through the discharge fitting 34 flows into a common outlet manifold 40, connected to the several fittings 34, and from the manifold 40 the water is discharged through an outlet conduit 42 to a suitable drain reservoir or the like, shown at 44, where the temperature of the water is continuously monitored to assure uniform cooling procedures.

A thermometer 45 in each discharge line 39 is used to detect abnormal heat conditions in each runner, such as steam pockets, or excessive heat resulting from progressive thinning of the runner wall resulting from the abrasive effect of the molten flow thereupon. In these circumstances, valves 46 respectively controlling flow through inlet lines 48 connected to inlet fittings 22, can be used to modulate flow through lines 48. One may thus increase or decrease flow through said individual inlet line to lower or raise the temperature of the water circulated through the affected runner 10.

It will be understood, and is believed to require no separate illustration, that a particular range of temperatures would be decided upon, taken at the drain reservoir location. It might be considered, for example, that if the temperatures taken at this location exceed a predetermined maximum value, then the temperature of the water directed to the inlet manifold would be lowered to an extent found sufficient to cause the temperature of the used water to drop back to a temperature within the desired range. In this way, uniform cooling can be effected, from end-to-end of the runner assembly. The controlled cooling of the slag in this way would thus reduce wear upon the runners, and at the same time, will minimize the formation of "stones" or other foreign objects that have heretofore tended to prevent maximum efficient utilization of the slag for purposes such as the formation of special slag compositions for use in the manufacture of glass.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. A runner for conducting a stream of molten slag from a blast furnace, comprising:

(a) a body hollowly formed to define therein a chamber through which water may be circulated as a cooling medium, the body having an exterior end-to-end channel providing a slag passage in heat-exchanging relation to the chamber; and (b) a cooling tube having one end adapted for connection to a source of water under pressure, the tube extending along both sides of the channel in heat-exchanging relation thereto and having its other end opening into the chamber for circulation of the water first through the tube and thereafter through the chamber exteriorly of the tube, the chamber having an outlet port through which the water may be discharged after being so circulated.

2. A runner as in claim 1 wherein the body is of metal.

3. A runner as in claim 1 including means in the chamber for circulating water, after it exits from the tube, in a path that is substantially the reverse of that in which the water is circulated during its flow through the tube.

4. A runner as in claim 1 wherein the tube includes first and second longitudinal portions respectively extending along opposite sides of the channel and connected at one end by a transverse portion extending across and below the channel.

5. A runner as in claim 4 wherein the tube inlet and outlet are at the other ends of the longitudinal tube portions.

6. A runner as in claim 5 in which the transverse tube portion is adjacent one end of the body and the tube inlet and outlet are adjacent the other end of the body.

7. A runner as in claim 6 in which the chamber is divided longitudinally into side-by-side halves, one longitudinal tube portion extending within one-half of the chamber and the other extending within the other half.

8. A runner as in claim 7 the respective halves of the chamber are in communication only at said one end of the body, whereby to recirculate water within the chamber, after it exits the tube, in a direction which is the reverse of the direction in which the water is circulated while flowing through the tube.

9. A runner as in claim 8 including a partition extending longitudinally and centrally of the slag channel within the body and terminating short of said one end of the body, whereby to produce the division of the chamber into halves and provide the communication therebetween.

10. A runner for conducting a stream of molten slag from a blast furnace, comprising:

(a) a metallic, hollow, trough-shaped body having an end-to-end channel providing a flow path for molten slag, the hollow formation of the body defining therein a cooling chamber extending the full length of the channel in heat-exchanging relation therewith;

(b) a partition within the body extending longitudinally thereof and dividing the chamber into first and second halves respectively extending along opposite sides of the channel, there being an opening at one end of the body providing communication between said halves of the chamber; and (c) a generally U-shaped tube mounted within the chamber in closely spaced relation to the channel, the tube having first and second longitudinal portions disposed within the first and second halves, respectively, of the chamber, and having a transverse portion connecting the longitudinal portions and extending across the chamber in the area of the communicating opening, the first longitudinal tube portion having an inlet and the second longitudinal portion having an outlet both of which are disposed at the other end of the body, the inlet being connectable to a source of water under pressure and the outlet discharging directly into the chamber, whereby water entering the tube will flow in a generally U-shaped path about the channel in one direction and upon discharge from the outlet will flow into the chamber to fill the same and flow exteriorly of the tube about the channel in a reversed U-shaped path, the chamber having a drain opening adjacent the tube inlet through which the water can be discharged from the chamber after flowing therethrough through said reversed path.

11. A runner as in claim 10 wherein the runner has a bottom wall spaced downwardly from the channel, the partition extending longitudinally and centrally of the channel and being connected between the bottom wall and the channel.

12. A runner as in claim 10 wherein said longitudinal and transverse portions of the tube are confined wholly within the chamber.

13. A runner as in claim 12 wherein the longitudinal and transverse portions of the tube are in spaced relation to the walls of the slag channel and cooling chamber.

14. A runner for conducting a stream of molten slag from a blast furnace, comprising a trough-shaped body hollowly formed to define a chamber for circulating a cooling liquid therethrough; a tube extending within the chamber in the form of at least one "U" and connected to a source of said liquid, the tube having a discharge opening for emptying the liquid directly into the chamber after passage in one direction along said "U"; and means for causing the liquid so discharged to circulate inside the chamber along a path following said "U" in a reverse direction, the chamber having a drain opening for removing the cooling liquid after it has traveled in reverse over the full length of its U-shaped path.

* * * * *